United States Patent [19]

Satoh et al.

[11] Patent Number: 4,676,844

[45] Date of Patent: Jun. 30, 1987

[54] PRODUCTION OF FORMABLE THIN STEEL SHEET EXCELLENT IN RIDGING RESISTANCE

[75] Inventors: Susumu Satoh; Saiji Matsuoka; Takashi Obara; Kozo Tsunoyama; Toshio Irie, all of Chiba, Japan

[73] Assignee: Kawasaki Steel Corporation, Kobe, Japan

[21] Appl. No.: 835,053

[22] Filed: Feb. 28, 1986

[30] Foreign Application Priority Data

| | | | |
|---|---|---|---|
| Mar. 6, 1985 | [JP] | Japan | 60-43986 |
| Mar. 6, 1985 | [JP] | Japan | 60-43987 |
| Mar. 6, 1985 | [JP] | Japan | 60-43988 |
| Mar. 6, 1985 | [JP] | Japan | 60-43989 |
| Mar. 6, 1985 | [JP] | Japan | 60-43983 |
| Mar. 6, 1985 | [JP] | Japan | 60-43984 |
| Mar. 6, 1985 | [JP] | Japan | 60-43985 |
| May 15, 1985 | [JP] | Japan | 60-101563 |

[51] Int. Cl.[4] ..... C21D 8/02; C21D 8/04; B21B 9/00

[52] U.S. Cl. ..... 148/12 C; 72/202; 72/364; 72/365

[58] Field of Search ..... 70/200, 202, 364, 365, 70/700; 148/12 R, 12 C

[56] References Cited

U.S. PATENT DOCUMENTS

| | | | |
|---|---|---|---|
| 4,016,740 | 4/1977 | Gondo et al. | 148/12 C X |
| 4,087,289 | 5/1978 | Gondo et al. | 148/12 R |
| 4,292,097 | 9/1981 | Nakazato et al. | 148/12 C |

FOREIGN PATENT DOCUMENTS

| | | | |
|---|---|---|---|
| 56-41006 | 4/1981 | Japan | 72/202 |
| 472985 | 9/1975 | U.S.S.R. | 148/12 R |
| 763478 | 9/1980 | U.S.S.R. | 148/12 R |
| 819194 | 4/1981 | U.S.S.R. | 148/12 R |

*Primary Examiner*—E. Michael Combs
*Attorney, Agent, or Firm*—Balogh, Osann, Kramer, Dvorak, Genova & Traub

[57] ABSTRACT

A process for producing a formable thin steel sheet excellent in ridging resistance. Said process comprises finishing a low carbon steel at a strain rate of not less than 300 ($s^{-1}$) in a temperature range of 800° to 300° C. in at least one pass when the low carbon steel is rolled into a specified thickness, and subsequently performing recrystallization annealing.

8 Claims, 9 Drawing Figures

○ Rolling Under Tension

● Rolling Under no Tension

PRODUCTION OF FORMABLE THIN STEEL SHEET EXCELLENT IN RIDGING RESISTANCE

BACKGROUND OF THE INVENTION

1. Field of the Invention

The present invention relates to a thin steel sheet excellent in ridging resistance and formability. More specifically, the invention is concerned with developed results in developments and researches on the basis of the experimental acknowledgement that manufacturing steps can be reduced with no cold rolling step involved by controlling rolling conditions.

2. Related Art Statement

High ductility and high lankford value (r-value) are required in the case of thin steel sheets of a thickness of about 2 mm or less which are used as construction material, automobile vehicle body material, canning material and various surface-treated raw plates so as to attain excellent bending formability, bulging formability, and drawability.

The number of parts to be bulged in the forming process has been recently increasing to improve the yield of the steel sheet in the forming. Because, the bulging can reduce inflow of a material from wrinkle holding portion in the forming. Particularly, a high n-value (not less than 0.23) (strain hardening exponent) is required as the material characteristics for this purpose.

Even if the formability is excellent in a particular direction but planar anisotropy is large, wrinkles are formed after the forming, because the actual forming is two dimensional. If the anisotropy is small, an amount of an ear to be cut is small to reduce a blank area, thereby enhancing the yield of the steel sheet to a large extent. Such a mechanical anisotropy can be evaluated by $\Delta El$ (anisotropic parameter of elongation) and $\Delta r$ (anisotropic parameter of r value). $\Delta El \leqq 5\%$ and $\Delta r \leqq 0.5$ are required for the steel sheets excellently low in the anisotropy.

Further, the steel sheet to be formed is basically required to be excellent in the strength-elongation balance. This is because the steel sheet poor in the strength-elongation balance causes troubles such as wall cracks during the forming.

Particularly, when the high strenghtening is aimed at to reduce the thickness of the steel sheet, the strength-elongation balance becomes an important characteristic.

In this case, the realization of the following relation is an approximate indication showing that the steel sheet is excellent in the strength-elongation balance:

$$\text{T.S. (kg/mm}^2) \times \text{El(\%)} \geqq 1{,}500$$

Since these materials are mainly used on the outermost side of the finally formed products, the surface properties after the forming have come to be important.

Further, the steel sheets for automobiles are required to undergo a pretreatment before coating, that is, phosphate coating. For this reason, the phosphate coating property becomes one of factors as the properties of the steel sheets. If the phosphate coating property is not good, the succeeding bake-on coating is not successful.

Moreover, the demand for the corrosion resistance of the formable thin steel sheets has recently become severer and severer, and the use of the surface treated steel sheets have rapidly increased.

Since the automobiles used in North Europe and North America are required to withstand the corrosion by snow-melting salt agent, they are required to have severer corrosion resistance.

On the other hand, even if the surface treated steel sheet is specially used, the corrosion resistance will be deteriorated under the conditions that the steel sheets are likely to be damaged during forming. Thus, the adhesion between the steel sheet as the base and the surface treated layer is extremely important for the surface treated steel sheet.

Furthermore, steel sheets for automobiles are required to be thinner to improve the fuel consumption of the automobiles. There occurs a problem in thus thinned steel sheet that the bulging rigidity of the formed product is lowered. For this reason, the formed product is easily deflected when an external force is applied thereto. On the other hand, since the bulging rigidity of the steel sheet is proportional to the Young's modulus, to increase the Young's modulus of the steel sheet plane is to increase the bulging property of the steel sheet. In this case, excellent bulging property can be obtained if the average Young's modulus among those in three directions, i.e., a rolling direction (hereinafter referred to as L direction), a direction orthogonal to the rolling direction (hereinafter referred to as C direction) and a direction extending at 45° with respect to the rolling direction (hereinafter referred to as D direction) is not less than 22,000 kg/mm$^2$.

These formable thin steel sheets are ordinarily produced in the following steps:

Mainly, a low carbon steel is first used as a raw steel material, and converted into a steel slab of a thickness of about 200 mm by continuous casting or ingot making-slabbing, which is converted into a hot rolled steel sheet of a thickness of about 3 mm through hot rolling. This hot rolled steel sheet is subsequently pickled and cold rolled to obtain a steel sheet of a desired thickness, which is subjected to a recrystallization treatment through box annealing or continuous annealing to obtain a final product.

The largest defect of this manufacturing process is that the steps are lengthy, and energy, number of staff and time necessary for obtaining the product are not only huge but also various problems on the quality, particularly the surface properties, of the product disadvantageously take place during the long manufacturing steps.

As mentioned above, it has been indispensable to included the cold rolling step (rolling temperature: less than 300° C.) in the process of producing the formable thin steel sheets.

The cold rolling step not only attains the desired reduction of thickness, but also serves to promote the growth of crystalline grains in the orientation of (111), which is advantageous for the deep drawability, in the final annealing step through utilization of the plastic strain introduced by the cold forming.

However, since the deformation resistance of the steel sheet is extremely higher in the cold forming as compared with the hot forming, energy required for rolling is huge and wear of the rolling rolls is considerable. In addition, rolling troubles such as slip are likely to occur.

To the contrary, if rolling is possible and particularly excellent formability is obtained at a relatively higher temperature range (so-called warm temperature range) of not less than 300° C. to not more than 800° C., the above problems can be completely removed to give large merits in the production.

On the other hand, there is a large problem in the production through the warm rolling. This is ridging. The ridging is a defect of the surface unevenness produced during the forming of the product. Thus, since the formed product is used mainly on the outermost side of the articles, this is a fatal defect for this steel sheet.

Metallogically speaking, the ridging is originated from the fact that a group of crystal oriented grains (for instance, a group of [100]-oriented grains) difficult to be divided even after undergoing formingrecrystallization step remains as being expanded in a rolling direction. In general, the ridging is likely to occur in a circumstance in which forming is carried out at a relatively high temperature in a ferrite ($\alpha$) range as in a warm rolling. Particularly, when the draft in the warm range is high (that is, as in the case of the production of the thin steel sheet), the ridging is conspicuous.

With complication and high grade tendency of the formed products, these formable steel sheets frequently undergo severe forming, and therefore are required to have excellent ridging resistance.

By the way, processes of producing iron and steel materials have recently remarkably varied, and the formable thin steel sheets are not exceptional, either.

That is, according to the conventional processes, a molten steel is converted to a steel slab of a thickness of about 250 mm through ingot making-slabbing, which is uniformly heated and soaked in a heating furnace and converted into a sheet bar of a thickness of about 30 mm in a rough hot rolling step, and then converted into a hot rolled steel strip of a desired thickness through finish hot rolling. To the contrary, recently, the slabbing step has first been able to be omitted through introduction of the continuous casting process and there is a tendency that the heating temperature of the steel slab is reduced from a conventional temperature of around 1,200° C. to around 1,100° C. or a lower temperature aiming at the improvement of the material characteristics and energy saving.

On the other hand, there has been being practically used a new process in which a steel sheet of a thickness of not more than 50 mm is instantly produced from a molten steel to omit the heating treatment and the roughly rolling step in the hot rolling.

However, these new producing processes are disadvantageous in that they all fracture the tissues (cast tissues) formed through solidification of the molten steel. Particularly, it is extremely difficult to break the strong cast texture having {100} <uvw> as main orientation formed during the solidification.

As a result, ridging is likely to occur in the final steel sheet, and particularly the warm rolling promotes the ridging.

There have been heretofore disclosed some processes for producing the deep drawable steel sheets by warm rolling, for instance, in Japanese Patent Publication No. 47-30,809, and Japanese Patent Application Laid-open Nos. 49-86,214, 59-93,835, 59-133,325, 59-185,729 and 59-226,149. They are all characterized in that recrystallization treatment is carried out immediately after rolling in a warm range, and are an innovative technique which enables omission of the cold rolling step.

However, these prior art techniques have paid no attention to the improvement on the above ridging resistance. In this respect, the warm rolling is generally less advantageous than the cold rolling with respect to the ridging resistance of the thin steel sheet.

SUMMARY OF THE INVENTION

An object of the present invention is to provide a process for producing a thin steel sheet excellent in ridging resistance and formability through reduced steps with no cold rolling step involved.

It is another object of the present invention to provide a process of producing a thin steel sheet excellent in ridging resistance and bulging formability by reduced steps including no cold rolling step.

It is a still another object of the present invention to provide a method of producing a thin steel sheet excellent in ridging resistance and formability with small planar anisotropy by reduced steps including no cold rolling step.

It is a further object of the present invention to provide a process for producing a thin steel sheet excellent in ridging resistance, phosphate coating property and formability by reduced steps including no cold rolling step.

It is a still further object of the present invention to provide a process for producing a thin steel sheet excellent in ridging resistance and strength-elongation balance by reduced steps including no cold rolling step.

It is still further object of the present invention to provide a process for producing a thin steel sheet excellent in ridging resistance, formability and hot metal plate adhesion.

It is a still further object of the present invention to provide a process for producing a thin steel sheet excellent in ridging resistance and bulging rigidity by reduced steps including no cold rolling step.

According to a first aspect of the present invention, there is a provision of a process for producing a formable thin steel sheet, which process comprises rolling a low carbon steel at a strain rate of not less than 300 ($s^{-1}$) in a temperature range of 800°-300° C. in at least one pass when the low carbon steel is rolled to a specific thickness, and then recrystallization annealing the resulting rolled steel sheet.

According to a second aspect of the present invention, there is a provision of a process for producing a formable thin steel sheet excellent in ridging resistance and bulging formability, which process comprises rolling a low carbon steel at a strain rate ($\dot{\epsilon}$) of not less than 300 $s^{-1}$ and $\epsilon \geqq 0.8T+60$ in a temperature range of 800° to 300° C. in at least one pass when the low carbon steel is rolled to a specific thickness, and succeedingly performing recrystallization annealing.

According to a third aspect of the present invention, there is a provision of a process for producing a formable thin steel sheet excellent in ridging resistance with small planar anisotropy, which process comprises rolling a low carbon steel at a strain rate ($\dot{\epsilon}$) of not less than 300($s^{-1}$) in a temperature range of 800 to 300° C. in at least one pass under the conditions that the strain rate and the coefficient of friction ($\mu$) meet the relation of $\epsilon/\mu \geqq 1{,}000$, when the low carbon steel is rolled to a specific thickness, and subsequently performing recrystallization annealing.

According to a fourth aspect of the present invention, there is a provision of a formable thin steel sheet excellent in ridging resistance with small planar anisotropy, which process comprises rolling a low carbon steel at a strain rate of not less than 300 ($s^{-1}$) in a temperature range of 800° to 300° C. in at least one pass under application of tension when the low carbon steel sheet is rolled to a specific thickness, and succeedingly performing recrystallization annealing.

According to a fifth aspect of the present invention, there is a provision of a process of producing a formable thin steel sheet excellent in ridging resistance and phosphate coating property, which process comprises rolling a low carbon steel at a strain rate of not less than 300 $s^{-1}$ in a temperature range of 800° to 300° C. in at least one pass when the low carbon steel is rolled to a specific thickness, and performing coiling at not more than 400° C. and subsequent recrystallization annealing.

According to a sixth aspect of the present invention, there is a provision of a process for producing a formable steel sheet excellent in ridging resistance and strength-elongation balance, which process comprises rolling a low carbon steel at a strain rate of not less than 300 $s^{-1}$ in a temperature range of 800° to 300° C. in at least one pass under the relation of $\dot{\epsilon}/R \geqq 2.0$ (R is a radius of roll (mm) when the low carbon steel is rolled into a specific thickness, and subsequently performing recrystallization annealing.

According to a seventh aspect of the present invention, there is a provision of a process for producing a thin steel sheet excellent in ridging resistance and plate adhesion, which process comprises rolling a low carbon steel at a strain rate ($\dot{\epsilon}$) of not less than 300 ($s^{-1}$) in a temperature range of 300° to 800° C. in at least one pass when the low carbon steel is rolled to a specific thickness and at a coiling temperature of not more than 400° C., and subsequently performing recrystallizing and plating in a hot metal dipping line of an in-line annealing system.

According to an eighth aspect of the present invention, there is a provision of a process for producing a formable thin steel sheet excellent in ridging resistance and bulging rigidity, which process comprises rolling a low carbon steel at a strain rate ($\dot{\epsilon}$) of not less than 300 $s^{-1}$ in a temperature range of 800 to 300° C. in at least one pass under the conditions that a limit strain rate ($\dot{\epsilon}_c$) complying with the following formula (1) meets the following inequality (2), when the low carbon steel is rolled to a specific thickness, and then performing recrystallization annealing.

$$\ln \dot{\epsilon}_c = -3{,}650/(273+T)+11.5 \quad (1)$$

in which T is a rolling temperature (°C.).

$$0.5\dot{\epsilon}_c \leqq \dot{\epsilon} \leqq 1.5\dot{\epsilon}_c \quad (2)$$

These and other objects, features and advantages of the present invention will be well appreciated upon reading of the invention when taken in conjunction with the attached drawings with understanding that some modifications, variations and changes of the same could be easily done by the skilled in the art to which the invention pertains without departing from the spirit of the invention or the scope of the claims appended hereto.

BRIEF DESCRIPTION OF THE DRAWINGS

For better understanding of the invention, reference is made to the attached drawings, wherein.

DETAILED DESCRIPTION OF THE INVENTION

First, investigation results forming basis of the present invention will be explained below:

TABLE 1

| Steel | C | Si | Mn | P | S | N | (wt %) Al |
|---|---|---|---|---|---|---|---|
| (A) | 0.035 | 0.02 | 0.22 | 0.012 | 0.008 | 0.0036 | 0.045 |
| (B) | 0.002 | 0.01 | 0.13 | 0.009 | 0.004 | 0.0024 | 0.035 |

Test samples are two kinds of hot rolled steel sheets of low carbon aluminum killed steel shown in Table 1. Test samples A and B were each heated and soaked at 600° C., and then rolling was performed at a draft of 30% in one pass.

Figure 1:
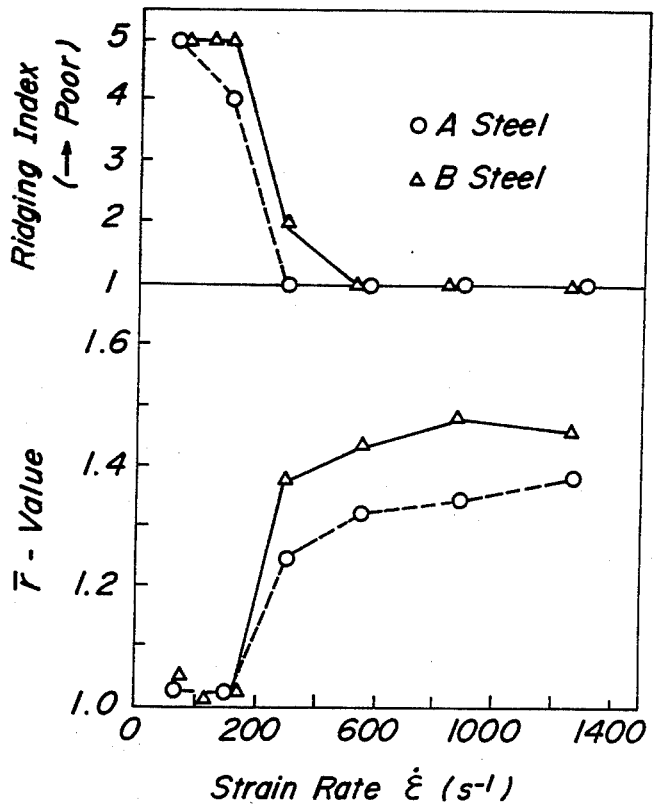
FIG. 1 is a graph showing influences of a rolling strain rate upon $\bar{r}$-value and ridging property.

In FIG. 1 are shown the relations of the strain rate ($\dot{\epsilon}$) to the $\bar{r}$-value and the ridging index after annealing (soaking temperature: 800° C.) at that time.

The r-value and the ridging resistance largely depend upon the strain rate, and were extremely improved by making the strain rate not lower than 300 $s^{-1}$ at the rolling temperature of 600° C.

Figure 2:
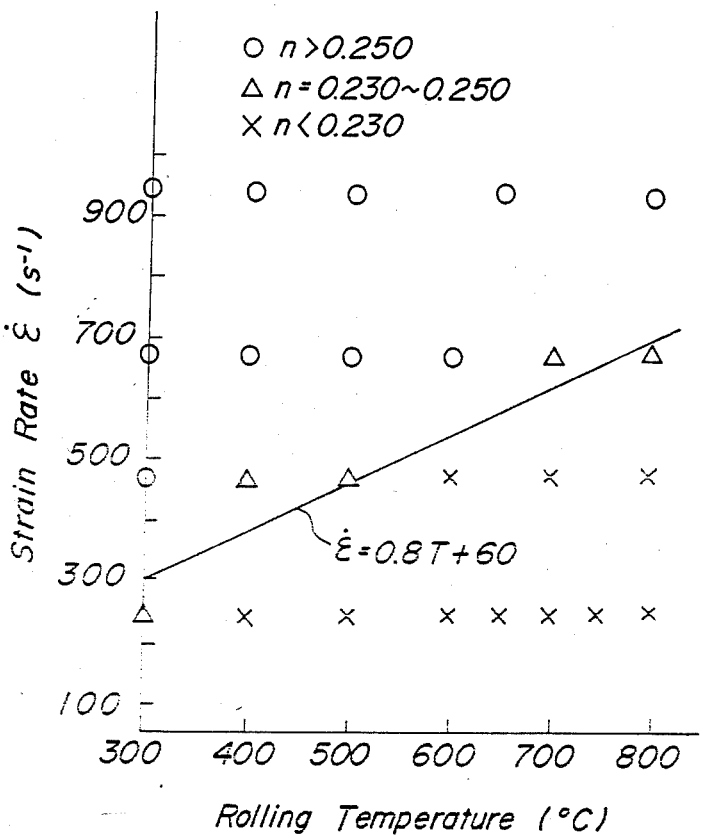
FIG. 2 is a graph showing the influence of the rolling temperature and the strain rate upon n-value.

FIG. 2 shows the relation between the strain rate and the rolling temperature influencing the forming hardenability index, n-value, after application of 1.0% skin pass rolling subsequent to the annealing with use of Steel B shown in Table 1.

$$\dot{\epsilon} \geqq 0.8T+60$$

When the relation between the strain rate and the rolling temperature is fallen in the above inequality, $n \geqq 0.230$, so that a steel sheet excellent in bulging formability can be obtained.

Figure 3:
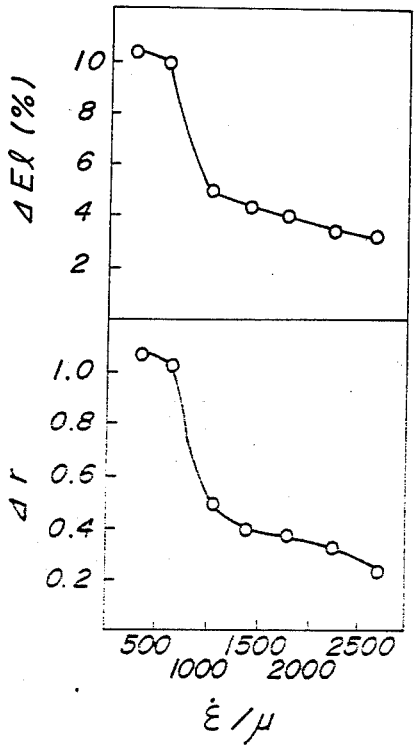
FIG. 3 is a graph showing the relation of the rolling strain rate and the coefficient of friction upon the planar anisotropy.

FIG. 3 shows the relations between the elongation and the anisotropy of r-value and the $\epsilon/\mu$ in the annealed samples when Test Steel (B) shown in Table 1 was used. The coefficient of friction was varied within a range of 0.6 to 0.06 by changing the lubricating conditions. Mineral oil was used as lubricant. The planar anisotropy was extremely decreased under the condition of $\dot{\epsilon}/\mu \geqq 1{,}000$.

TABLE 2

| Steel | C | Si | Mn | P | S | N | (wt %) Al |
|---|---|---|---|---|---|---|---|
| (C) | 0.002 | 0.01 | 0.14 | 0.009 | 0.006 | 0.0026 | 0.029 |

Next, a steel having a composition shown in Table 2 was converted into a sheet bar of a thickness of 25 mm by a continuous casting-rough hot rolling, which was rolled at a high strain rate ($562s^{-1}$) in a sixth stand of six rows of finish rolling mills while a tension of 3 $kg/mm^2$ was applied particularly between the sixth stand and a fifth stand.

Figure 4:
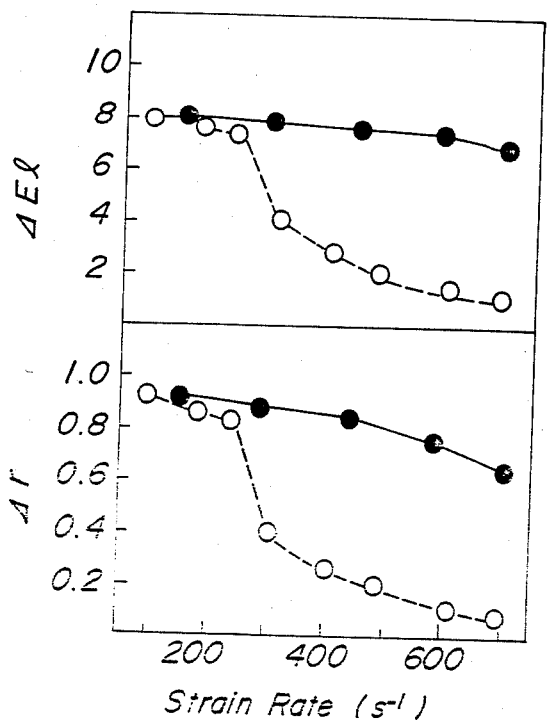
FIG. 4 is a graph showing the influence of rolling strain rate and the tension upon the anisotropic properties of the elongation and r-value.

The finish temperature was 682° C., and the thickness was 1.0 mm. In FIG. 4 is shown the elongation and the anisotropy of r value after the steel sheet was annealed.

The planar anisotropy of the sample having undergone the rolling under tension was extremely reduced at a strain rate of not less than 300 $s^{-1}$. The anistropy was determined from the following equations:

$$\Delta r=(r_L+r_C-2r_D)/2,$$

$$\Delta El=(El_L+El_C-2El_D)/2.$$

TABLE 3

| Steel | C | Si | Mn | P | S | N | (wt %) Al |
|---|---|---|---|---|---|---|---|
| (D) | 0.002 | 0.01 | 0.13 | 0.012 | 0.010 | 0.0028 | 0.0022 |

A steel of a composition shown in Table 3 was converted into a sheet bar of a thickness of 25 mm by continuous casting-rough hot rolling, which was rolled by a sixth stand of six rows of finish rolling mills at a high strain rate (573 $s^{-1}$). The finish temperature is 652° C., and the thickness 1.2 mm.

The steel sheet was coiled at various coiling temperatures, and phosphate coating property after annealing was examined.

Figure 5:
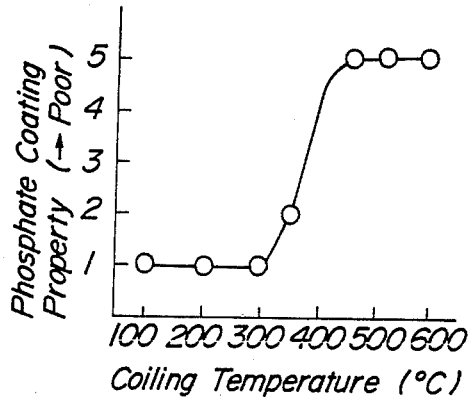
FIG. 5 is a graph showing the influence of the coiling temperature upon phosphate coating property.

FIG. 5 shows the relation between the coiling temperature and the phosphate coating property. The phosphate coating property was extremely improved at the coiling temperature of not more than 400° C.

The phosphate coating property was evaluated based on a pin hole-occupying area percentage when the below-mentioned pin hole test was carried out after the dewaxing, water-washing, and phosphate treatment of the steel sheet.

The phosphate treatment was carried out such that BT 3112 made by Japan Parkarizing Co., Ltd. was used and adjusted to a total acidity of 14.3 and a free acidity of 0.5 at 55° C., and then sprayed onto the steel sheet for 120 seconds.

That is, according to the pin hole test, portions at which remained a phosphate crystals having not been attached to the surface of the steel sheet was detected through adhering a filter paper into which was impregnated a reagent coloring upon reaction with iron ions on a surface to be tested, and was indicated by figure as pin hole-occupying area percentage through image analysis. The evaluation standard on the chemical conversion property is:

1. The pin hole-occupying area percentage is not more than 0.5%
2. The pin hole-occupying area percentage is 0.5 to 2%.
3. The pin hole-occupying area percentage is 2 to 9%.
4. The pin hole-occupying area percentage is 9–15%.

"1" and "2" show the pin hole-occupying area percentages which pose practically no problems.

Figure 6:
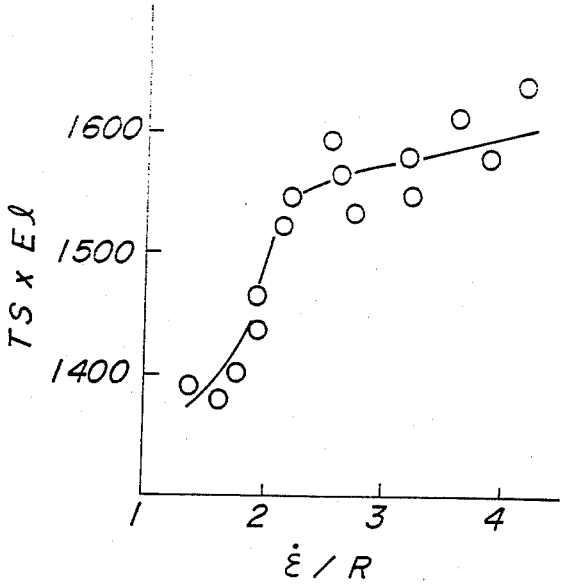
FIG. 6 is a graph showing the influence of the strain rate and the radius of work rolls upon the strength-ductility balance.

The relation of $\epsilon/R$ influencing the strength-elongation balance of the steel sheet after annealing (soaking at 800° C.) was examined by using Steel (B) in Table 1, and shown in FIG. 6. $TS\times El\geqq 1{,}500$ was easily attained by setting $\dot{\epsilon}/R\geqq 2.0$, and the excellent strength-elongation balance was obtained

TABLE 4

| Steel | C | Si | Mn | P | S | Al | N | (wt %) Nb |
|---|---|---|---|---|---|---|---|---|
| (E) | 0.003 | 0.01 | 0.13 | 0.010 | 0.006 | 0.040 | 0.0025 | 0.022 |

A steel (E) of a composition shown in Table 4 was converted into a sheet bar of a thickness of 25 mm by continuous casting-rough hot rolling, which was rolled at a sixth stand of six rows of finish rolling mills at a high strain rate (562 $s^{-1}$). The finish temperature was 670° C. and the thickness was 1.2 mm.

The steel sheet was coiled at various coiling temperatures, annealed at a soaking temperature of 810° C. and continuously zinc-plated in a continuous hot zinc dipping line without being pickled. Results on zinc plate adhesion test of this steel sheet are shown in FIG. 7.

In the bending test, judgement was made based on peeling limit values in a case where bending was done from an adhering bending (bending radius: OT) to a bending radius (4T) twice as much as the thickness of the steel sheet. Peeling limit values at extrusion forming were simultaneously examined by using Erichsen value.

Figure 7:
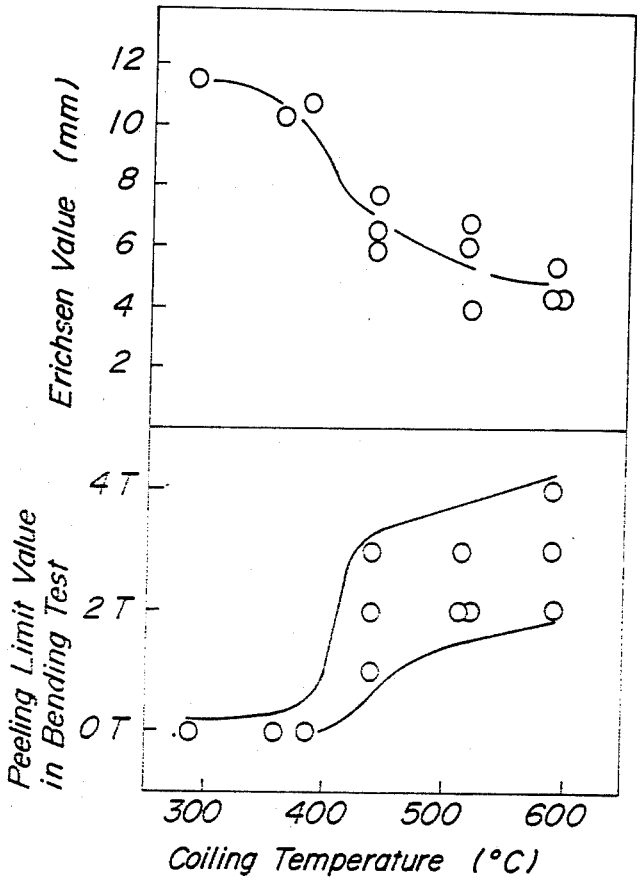
FIG. 7 is a graph showing the influence of the coiling temperature upon the plate adhesion.

From FIG. 7, it is seen that extremely excellent adhesion and Erichsen value can be obtained by setting the coiling temperature at not more than 400° C.

Figure 8:
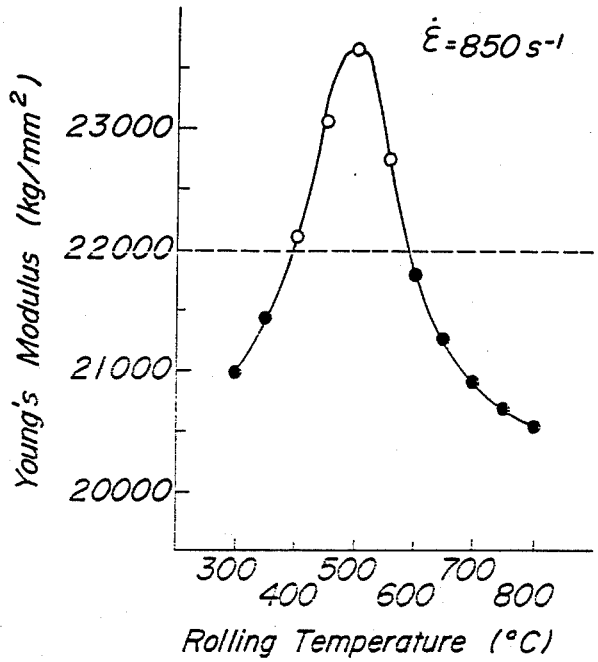
FIG. 8 is the influence of the rolling temperature upon the Young's modulus.

Further, Test Steel (B) in Table 1 was employed, heated and soaked at 300°–800° C., and then rolled at a draft of 30% and a strain rate of 850 $s^{-1}$ in one pass. The relation between the rolling temperature and the Young's modulus (the average value in L,C,D three directions) after annealing at that time is shown in FIG. 8. Young's modulus takes a peak at 500° C., and was not less than 22,000 $kg/mm^2$ at 400° to 580° C.

Figure 9:
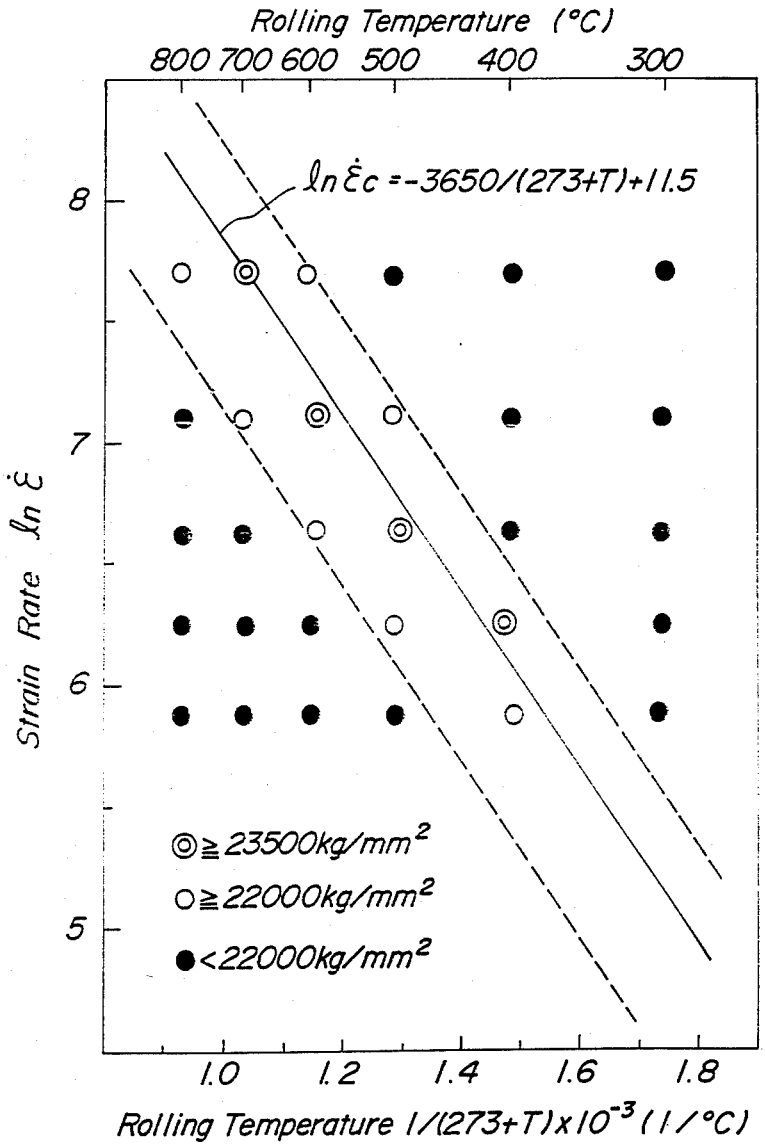
FIG. 9 is a graph showing the influence of the rolling temperature and the strain rate upon the Young's modulus.

Next, the relation between the limit strain rate ($\dot{\epsilon}_c$) and the rolling temperature (T) influencing the Young's modulus when the strain rate was varied is shown in FIG. 9. Young's moduluses were always not less than 23,500 $kg/mm^2$ for $\dot{\epsilon}_c$ satisfying the $\ln \dot{\epsilon}_c=-3{,}650/(T+273)+11.5$, and not less than 22,000 $kg/mm^2$ when $\dot{\epsilon}$ is in a range of $0.5\ \dot{\epsilon}_c\leqq\dot{\epsilon}\leqq 1.5\dot{\epsilon}_c$.

Having repeatedly made investigations on the basis of the above fundamental data, the present inventors have confirmed that the thin steel sheet excellent in formability, bulging formability, ridging resistance, phosphate coating property, strength-elongation balance, plate adhesion and bulging rigidity with small planar anisotropy can be produced by controlling the producing conditions as follows:

(1) Steel composition:

The effect due to rolling at a strain rate do not essentially depend upon the steel composition. However, it is preferable that the amounts of interstitial solid souble elements, C and N, are not more than 0.10% and not more than 0.01%, respectively to assure the formability at not less than a certain level. The reduction of oxygen in the steel through the addition of Al is advantageous in improvement of the quality, particularly, the ductility.

In order to obtain more excellent formability, a specific element which can deposit and fix C and N in a form of stable carbond nitride, for instance, Ti, Nb, Zr, B or the like, is effectively added.

P, Si, Mn or the like may be added to obtain a high strength as desired.

(2) Production of a raw material to be rolled:

A steel slab obtained according to the conventional process, that is, ingot making-slabbing or continuous casting, may be naturally employed.

The heating temperautre of the steel slab is appropriately from 800° to 1,250° C. Less than 1,100° C. is preferred from the standpoint of the energy saving. A so-called CC-DR (continuous casting-direct rolling) in which rolling of the steel slab from the continuous casting is started without being reheated may be naturally employed.

On the other hand, since a process in which a raw material of not more than about 50 mm to be rolled is directly cast from a molten steel (sheet bar caster process and a strip caster process) is economically effective from the standpoint of energy saving and manufacturing step reduction, it is particularly advantageous as the process of manufacturing the raw material to be rolled.

(3) Rolling step:

This step is the most important. In a process of rolling a low carbon steel to a specific thickness, it is indispensable to finish the steel sheet at a strain rate of not less than 300 $s^{-1}$ in a temperature range of 800°-300° C. in at least one pass. It is preferable to finish the steel sheet under the condition that the coefficient of friction ($\mu$) meets $\dot{\epsilon}/\mu \geqq 1{,}000$. Further, it is preferable to perform rolling under the relation that $\dot{\epsilon}/R \geqq 2.0$. Furthermore, it is preferable to perform finishing at a coiling temperature of not more than 400° C. In addition, it is preferable to perform rolling under the conditions that while the strain rate ($\dot{\epsilon}$) is not less than 300 $s^{-1}$, the limit strain rate ($\dot{\epsilon}$) complying with the following formula (1) satisfies the following unequality (2).

$$1\,n\,\dot{\epsilon}_c = -3{,}650/(273+T)+11.5 \quad (1)$$

in which T is a rolling temperature (°C.)

$$0.5\dot{\epsilon}_c \leqq \dot{\epsilon} \leqq 1.5\dot{\epsilon}_c \quad (2)$$

With respect to the rolling temperature, if the rolling is carried out at a high temperature range of not less than 800° C., it is difficult to obtain the formability and the ridging resistance through controlling the strain rate, while if it is less than 300° C., various problems similar to the above ones and peculiar to the cold rolling are produced due to remarkable increase in deflecting resistance. Thus, 800° to 300° C., particularly 700° to 400° C. is preferred.

If the strain rate is less than 300 $s^{-1}$, intended quality can not be assuredly obtained.

The range of the strain rate is preferably from 500 to 2,500 $s^{-1}$. If the condition of $\dot{\epsilon}/\mu = 1{,}000$ is not satisfied, the planar anisotropy becomes larger.

Although the tension depends upon the rolling temperature, application of not less than 1 kg/mm is preferable.

Any arrangement and structure of the rolling mill, number of the roll passes and distribution of drawability therebetween may be arbitrary so long as the above conditions are met.

The strain rate ($\dot{\epsilon}$) is to comply with the following formula:

$$\dot{\epsilon} = \frac{2\pi n}{60\sqrt{r}} \cdot \sqrt{\frac{R}{H_0}} \cdot \ln\left(\frac{1}{1-r}\right)$$

n which n is number of revolutions of roll: (rpm), r: Draft (%)/100.

R: Roll radius (mm)

$H_o$: Thickness before rolling (mm)

It has been described in the above that the temperature in the coiling subsequent to the rolling at this high strain rate influences the chemical conversion property, and that the excellent phosphate coating property can be obtained by setting this temperature at not more than 400° C.

(4) Annealing:

It is necessary to recrystallization anneal the steel sheet having undergone rolling. The annealing way may be either one of the box annealing and the continuous annealing.

The latter is more advantageous from the standpoint of the uniformity and productivity.

According to the annealing way, recrystallization and plating are carried out in a continuous hot metal dipping line of an in-line annealing system.

The heating temperature is suitably in a range of from the recrystallization temperature to 950° C.

With respect to a steel sheet having a content of carbon of not less than 0.01 wt%, it is advantageous to carry out overaging treatment after soaking for increasing the quality of the steel sheet.

The average values of the $\bar{r}$-value and Young's modulus ($\bar{E}$) in three directions L, C and D were determined by the following equations:

$$\bar{r} = (r_L + r_C + 2r_D)/4$$

$$\bar{E} = (E_L + E_C + 2E_D)/4$$

$r_L$, $r_C$ and $r_D$ are r-values in the directions L, C and D, respectively, while $E_L$, $E_C$ and $E_D$ are Young's moduluses in the directions L, C and D, respectively.

The limit strain rate ($\dot{\epsilon}_C$), which depends upon the rolling temperature and the strain rate ($\dot{\epsilon}$), is a limit strain rate capable of giving Young's modulus of not less than 23,500 (kg/mm$^2$) for the products recrystallization annealed after rolling. The above formula (1) is an empirical formula obtained from experiments of which results are shown in FIG. 3, and is represented by a coefficient of the rolling temperature.

Annealing treatment may be carried out while the steel sheet is maintained in a form of a taken-up coil after rolling.

Since the rolling temperature is in a far lower temperature range than in the conventional hot rolling, the scale on the surface of the steel sheet is thin and therefore easily removed. Therefore, besides the conventional removal of the scale with an acid, scale may be removed mechanically or by controlling the annealing atmosphere (in a continuous hot metal dipping line).

Skin pass rolling at not more than 10% may be performed for the annealed steel sheet to correct the profile and adjust the surface roughness.

The thus obtained steel sheet can be adopted as a raw material for original plate of the surface treated formable steel sheet. As the surface treatment, there may be zinc plating (including an alloy, tin plating and enamel).

Although the mechanism for improving the ridging resistance, formability, bulging formability, planar anisotropy, strength-elongation balance, plate adhesion, and bulging rigidity with respect to the behavior in the rolling at high strain rate according to the present invention, and the causes which give an excellent phosphate coating property by setting not more than 400° C. of the temperature of the coiling after the rolling at the high strain rate are not necessarily clear, they are thought to be in a close relation with the change in texture formation of the rolled material and the change in the strain in rolling.

Further, although the reason why the strain rate and the work roll radius in the rolling influence the elongation-strength balance is not clear, the factual correlaion has been already confirmed as shown in the following Examples.

EXAMPLES

The invention will be described in more detailed with reference to the following Examples and Comparative Examples. However, these Examples are given merely in the illustration of the invention, but never interpreted to limit the scope thereof.

In the following, the tension characteristic was obtained in a form of JIS No. 5 test piece.

Ridging resistance was evaluated as 1 (good) to 5 (poor) according to visual judgement of surface unevenness under application of 15% tension preliminary strain by using the JIS No. 5 test piece taken out in the rolling direction.

Since ridging was not actually observed in the conventional production of the low carbon cold rolled steel sheet, a standard for this evaluation had been not established. Therefore, in the present invention, a conventional index evaluation standard based on the visual inspection for the stainless steels was employed as they are.

Evaluations 1 and 2 show ridging resistance which poses no practical problems.

Steel Nos. 1–5:

Among steels with chemical compositions shown in Table 5, Steel Nos. 1–3 and 5 were produced by a converter-continuous casting process in which a steel slab was roughly rolled to a sheet bar of 20–30 mm in thickness after heating and soaking at 1,100°–950° C., while Steel No. 4 was converted into a sheet bar of 30 mm in thickness by a converter-sheet bar caster process.

TABLE 5

| Steel | C | Si | Mn | P | S | N | Al | (wt %) others |
|---|---|---|---|---|---|---|---|---|
| (1) | 0.032 | 0.02 | 0.26 | 0.013 | 0.008 | 0.0041 | 0.046 | — |
| (2) | 0.040 | 0.01 | 0.20 | 0.008 | 0.006 | 0.0026 | 0.032 | B 0.0025 |
| (3) | 0.003 | 0.02 | 0.08 | 0.010 | 0.010 | 0.0018 | 0.042 | — |
| (4) | 0.004 | 0.01 | 0.08 | 0.011 | 0.007 | 0.0026 | 0.015 | Ti 0.038 |
| (5) | 0.002 | 0.02 | 0.15 | 0.008 | 0.002 | 0.0016 | 0.030 | Nb 0.011 |

These sheet bars were converted to thin steel sheets of a thickness of 0.9 to 0.7 mm by using six rows of continuous finish rolling mills. High strain rate rolling was carried out by using the rear two rows of the rolling mills. The rolling conditions and material characteristics after continuous annealing (soaking temperature: 750°–810° C.) are shown in Table 6.

TABLE 6

| | Rolling conditions | | | Material characteristics | | | | | |
|---|---|---|---|---|---|---|---|---|---|
| Steel | 5th stand ($\dot{\epsilon}$) | 6th stand ($\dot{\epsilon}$) | Finish (°C.) | Y.S. (kg/mm$^2$) | T.S. (kg/mm$^2$) | El (%) | $\bar{r}$ | Ridging index | Remarks |
| (1) | 860 | 325 | 620 | 20 | 33 | 46 | 1.26 | 1 | |
| | 660 | 1,020 | 560 | 21 | 34 | 45 | 1.44 | 1 | |
| | 260 | 186 | 580 | 22 | 33 | 43 | 0.92 | 4 | * |
| (2) | 1,090 | 630 | 860 | 20 | 34 | 43 | 1.00 | 5 | * |
| | 582 | 265 | 610 | 19 | 31 | 46 | 1.43 | 2 | |
| (3) | 1,220 | 890 | 480 | 16 | 30 | 51 | 1.58 | 1 | |
| | 181 | 292 | 590 | 15 | 31 | 46 | 0.92 | 5 | * |
| | 654 | 1,020 | 830 | 18 | 30 | 47 | 1.02 | 3 | * |
| (4) | 860 | 290 | 480 | 14 | 30 | 51 | 1.75 | 1 | |
| | 1,520 | 1,060 | 580 | 15 | 29 | 52 | 2.05 | 1 | |
| (5) | 1,016 | 825 | 600 | 16 | 30 | 51 | 1.76 | 1 | |
| | 632 | 902 | 430 | 15 | 29 | 52 | 1.64 | 1 | |

Note:
*Comparative Example; no mark — Suitable Example

According to the present invention, thin steel sheet having excellent ridging resistance while showing high ductility and high r-value can be obtained through rolling at a high strain rate. Thus, the conventional cold rolling step can be omitted in the high strain rate rolling. Further, the invention is suitably applicable to sheet bar casting, strip caster and so on with respect to the raw materials. Thus, the invention can realize the simplification of a process for producing the thin steel sheet. Steel Nos. 6–8:

Steel slabs having chemical compositions shown in Table 7 were produced by the converter-continuous casting process or the sheet bar caster process. In the converter-continuous casting process, a sheet bar of 20 to 30 mm in thickness was obtained through rough rolling after heating and soaking at 1,100° to 950° C.

TABLE 7

| Steel | C | Si | Mn | P | S | N | Al | (wt %) others |
|---|---|---|---|---|---|---|---|---|
| (6) | 0.026 | 0.01 | 0.25 | 0.011 | 0.012 | 0.0040 | 0.036 | — |
| (7) | 0.001 | 0.01 | 0.06 | 0.008 | 0.004 | 0.0026 | 0.022 | Ti 0.036 |
| (8) | 0.002 | 0.01 | 0.08 | 0.006 | 0.002 | 0.0030 | 0.046 | Ti 0.030 Nb 0.005 |

These sheet bars were each converted into a thin steel sheet of 1.0 to 0.7 mm in thickness by using six rows of continuous finish rolling mills. Rolling at a high strain rate was carried out by using the final rows of the rolling mills. The rolling conditions and the material characteristics after the continuous annealing (soaking temperature: 750° to 810° C.) are shown in Table 8. Steel No. 6 was subjected to overaging treatment at 400° C. for 2 minutes as the continuous annealing conditions after the soaking.

TABLE 8

| Steel | Sheet bar producing process | Thickness (mm) | Hot rolling conditions: Strain rate ($s^{-1}$) | Hot rolling conditions: Finish temperature (°C.) | Material characteristics: T.S. ($kg/mm^2$) | Material characteristics: Y.S. ($kg/mm^2$) | Material characteristics: El (%) | Material characteristics: $\bar{r}$ | Material characteristics: Ridging index | Material characteristics: n-value | Remarks |
|---|---|---|---|---|---|---|---|---|---|---|---|
| (6) | rough rolling | 1.0 | 212 | 600 | 31 | 21 | 44 | 1.18 | 5 | 0.205 | * |
| | " | 1.0 | 410 | 630 | 31 | 20 | 45 | 1.25 | 2 | 0.210 | * |
| | " | 1.0 | 682 | 640 | 31 | 19 | 48 | 1.35 | 1 | 0.236 | |
| (7) | sheet bar caster | 0.8 | 294 | 450 | 30 | 14 | 47 | 0.92 | 5 | 0.208 | * |
| | " | 0.8 | 501 | 460 | 30 | 14 | 48 | 1.62 | 1 | 0.246 | |
| (8) | rough rolling | 0.7 | 516 | 745 | 30 | 15 | 48 | 1.35 | 1 | 0.216 | * |
| | " | 0.7 | 1,106 | 755 | 31 | 14 | 50 | 1.68 | 1 | 0.285 | |
| | " | 0.7 | 780 | 850 | 31 | 15 | 44 | 0.90 | 5 | 0.211 | * |

Note:
*Comparative Example

According to the present invention, the thin steel sheets having excellent ridging resistance while exhibiting the high n-value and r-value can be obtained by rolling at high strain rate. Thus, the conventional cold rolling step can not only be omitted, but also the sheet bar caster process and the strip caster process can be applied to the materials to be rolled. Therefore, the producing steps of the formable thin steel sheets can be simplified.

Steel Nos. 9–12:

Steel slabs having chemical compositions shown in Table 9 were produced by the converter-continuous casting process or the sheet bar caster process. In the converter-continuous casting process, a sheet bar of 20 to 30 mm in thickness was obtained through rough rolling after heating and soaking at 1,100° to 950° C.

TABLE 9

| Steel | C | Si | Mn | P | S | N | Al | others (wt %) |
|---|---|---|---|---|---|---|---|---|
| (9) | 0.03 | 0.02 | 0.21 | 0.010 | 0.012 | 0.0039 | 0.046 | — |
| (10) | 0.002 | 0.01 | 0.10 | 0.009 | 0.007 | 0.0028 | 0.028 | Ti: 0.031 |
| (11) | 0.002 | 0.01 | 0.12 | 0.008 | 0.006 | 0.0022 | 0.026 | Nb: 0.016 |
| (12) | 0.003 | 0.02 | 0.14 | 0.010 | 0.007 | 0.0025 | 0.022 | Ti: 0.22 Nb: 0.004 |

These sheet bars were each converted into a thin steel sheet of 0.8 to 1.2 mm in thickness by using six rows of continuous finish rolling mills. Rolling at a high strain rate was carried out by using the final row of the rolling mill. The rolling conditions and the material characteristics after the continuous annealing (soaking temperature: 750° to 810° C.) are shown in Table 10. Steel No. 9 was subjected to overaging treatment at 400° C. for 2 minutes as the continuous annealing conditions after the soaking.

TABLE 10

| Steel | Sheet bar producing process | Thickness (mm) | Rolling conditions: Strain rate ($s^{-1}$) | Rolling conditions: $\dot{\varepsilon}/\mu$ | Rolling conditions: Finish temperature (°C.) | Material characteristics: Y.S. ($kg/mm^2$) | Material characteristics: T.S. ($kg/mm^2$) | Material characteristics: El | Material characteristics: $\bar{r}$ | Material characteristics: ΔEl | Material characteristics: Δr | Material characteristics: Ridging index | Remarks |
|---|---|---|---|---|---|---|---|---|---|---|---|---|---|
| (9) | rough rolling | 1.0 | 412 | 634 | 712 | 21 | 33 | 42 | 1.31 | 9.2 | 0.96 | 1 | * |
| (9) | rough rolling | 1.2 | 560 | 2,800 | 680 | 20 | 31 | 46 | 1.53 | 0.8 | 0.06 | 1 | |
| (10) | rough rolling | 0.8 | 220 | 1,467 | 513 | 18 | 29 | 48 | 0.98 | 7.8 | 0.81 | 5 | * |
| (10) | sheet bar caster | 1.0 | 360 | 1,400 | 736 | 16 | 28 | 50 | 1.24 | 4.2 | 0.39 | 2 | |
| (11) | sheet bar caster | 0.8 | 970 | 4,850 | 538 | 15 | 29 | 52 | 1.92 | 1.2 | 0.10 | 1 | |
| (11) | rough rolling | 1.2 | 540 | 931 | 624 | 17 | 28 | 49 | 1.68 | 6.8 | 0.66 | 1 | * |
| (11) | rough rolling | 1.0 | 1,280 | 1,970 | 422 | 16 | 29 | 53 | 2.06 | 2.4 | 0.32 | 1 | |
| (12) | rough rolling | 0.8 | 850 | 2,833 | 912 | 17 | 29 | 50 | 1.01 | 8.2 | 0.76 | 4 | * |

Note:
* . . . Comparative Example

According to the present invention, the tin steel sheets having excellent ridging resistance with a small planar anisotropy while exhibiting the high elongation and r-value can be obtained by rolling at a high strain rate. Thus, the conventional cold rolling step can not only be omitted, but also the sheet bar caster process and the strip caster process can be applied to the materials to be rolled. Therefore, the producing steps of the formable thin steel sheets can be simplified.

Steel Nos. 13–16;

Steel sheets having chemical compositions shown in Table 11 were produced by the converter-continuous casting process or the sheet bar caster process. In the converter-continuous casting process, a sheet bar of 20 to 30 mm in thickness was obtained through rough rolling after heating and soaking at 1,100° to 950° C.

TABLE 11

| Steel | C | Si | Mn | P | S | N | Al | others (wt %) |
|---|---|---|---|---|---|---|---|---|
| (13) | 0.03 | 0.02 | 0.24 | 0.011 | 0.009 | 0.0032 | 0.047 | — |
| (14) | 0.002 | 0.01 | 0.15 | 0.009 | 0.007 | 0.0029 | 0.029 | B: 0.002 |
| (15) | 0.003 | 0.02 | 0.13 | 0.008 | 0.007 | 0.0025 | 0.022 | Ti: 0.031 |
| (16) | 0.002 | 0.01 | 0.14 | 0.010 | 0.008 | 0.0022 | 0.026 | Nb: 0.017 |

These sheet bars were each converted into a thin steel sheet of 0.8 to 1.2 mm in thickness by using six rows of continuous finish rolling mills. Rolling at high strain rate was carried out under application of tension by using the final two rows of the rolling mills. The rolling conditions and the material characteristics after the continuous annealing (soaking temperature: 750° to 810° C.) are shown in Table 12. Steel No. 13 was subjected to overaging treatment at 400° C. for 2 minutes as the continuous annealing conditions after the soaking.

TABLE 12

| Steel | Sheet bar producing process | Thickness (mm) | Rolling conditions: Strain rate ($s^{-1}$) | Tension (kg/mm²) | Finish temperature (°C.) | Material characteristics: Y.S. (kg/mm²) | T.S. (kg/mm²) | El (%) | $\bar{r}$ | ΔEl | Δr | Ridging index | Remarks |
|---|---|---|---|---|---|---|---|---|---|---|---|---|---|
| (13) | rough rolling | 1.2 | 454 | 3.2 | 665 | 21 | 34 | 44 | 1.33 | 2.4 | 0.31 | 1 | |
| (13) | sheet bar caster | 1.0 | 512 | 0 | 703 | 20 | 33 | 42 | 1.35 | 8.8 | 0.82 | 1 | * |
| (14) | " | 1.2 | 946 | 10.3 | 348 | 16 | 29 | 52 | 2.04 | 1.8 | 0.25 | 1 | |
| (14) | rough rolling | 0.8 | 245 | 3.0 | 533 | 18 | 28 | 48 | 1.10 | 8.3 | 0.75 | 5 | * |
| (15) | " | 0.8 | 1,209 | 0.8 | 465 | 15 | 29 | 52 | 2.02 | 2.2 | 0.32 | 1 | |
| (15) | " | 0.8 | 536 | 0 | 618 | 16 | 29 | 51 | 1.64 | 7.4 | 0.83 | 1 | * |
| (16) | " | 1.0 | 776 | 13.0 | 523 | 15 | 29 | 52 | 1.86 | 2.0 | 0.26 | 1 | |
| (16) | sheet bar caster | 1.2 | 506 | 5.6 | 718 | 16 | 28 | 50 | 1.52 | 2.2 | 0.28 | 1 | — |

Note:
*Comparative Example

According to the present invention, the thin steel sheets having excellent ridging resistance with small planar anisotropy while exhibiting the high elongation and r-value can be obtained by rolling at high strain rate under application of tension. Thus, the conventional cold rollng step can not only be omitted, but also the sheet bar caster process and the strip caster process can be applied to the materials to be rolled. Therefore, the producing steps of the formable thin steel sheets can be simplified.

Steel Nos. 17–20:

Steel sheets having chemical cmpositions shown in Table 13 were produced by the converter-continuous casting process or the sheet bar caster process. In the converter-continuous casting process, a sheet bar of 20 to 30 mm in thickness was obtained through rough rolling afer heating and soaking at 1,100° to 950° C.

TABLE 13

| Steel | C | Si | Mn | P | S | N | Al | (wt %) others |
|---|---|---|---|---|---|---|---|---|
| (17) | 0.032 | 0.02 | 0.26 | 0.018 | 0.010 | 0.0039 | 0.045 | B: 0.002 |
| (18) | 0.002 | 0.01 | 0.18 | 0.012 | 0.008 | 0.0022 | 0.032 | — |
| (19) | 0.003 | 0.02 | 0.08 | 0.009 | 0.009 | 0.0026 | 0.029 | Nb: 0.012 |
| (20) | 0.003 | 0.01 | 0.12 | 0.011 | 0.0018 | 0.0018 | 0.018 | Ti: 0.032 |

These sheet bars were each converted into a thin steel sheet of 0.2 to 0.8 mm in thickness by using six rows of continuous finish rolling mills. Rolling at a high strain rate was carried out by using the final row of the rolling mill. The rolling conditions and the material characteristics after the continuous annealing (soaking temperature: 750° to 810° C.) are shown in Table 14. Steel No. 17 was subjected to overaging treatment at 400° C. for 2 minutes as the continuous annealing conditions after the soaking.

TABLE 14

| Steel | Sheet bar producing process | Thickness (mm) | Hot rolling conditions: Strain rate ($s^{-1}$) | Finish temperature (°C.) | Coiling temperature (°C.) | Material characteristics: Y.S. (kg/mm²) | T.S. (kg/mm²) | El (%) | $\bar{r}$ | Ridging index | Phosphate coating property | Remarks |
|---|---|---|---|---|---|---|---|---|---|---|---|---|
| (17) | rough rolling | 1.0 | 512 | 620 | 554 | 21 | 34 | 42 | 1.21 | 1 | 5 | * |
| (17) | " | 0.8 | 229 | 590 | 398 | 22 | 33 | 43 | 0.88 | 4 | 3 | * |
| (18) | " | 1.2 | 653 | 880 | 680 | 18 | 29 | 46 | 1.02 | 5 | 5 | * |
| (18) | sheet bar caster | 0.8 | 1,249 | 430 | 389 | 16 | 30 | 51 | 1.96 | 1 | 1 | |
| (19) | " | 1.0 | 684 | 638 | 496 | 15 | 28 | 50 | 1.54 | 1 | 5 | * |
| (19) | rough rolling | 1.2 | 515 | 534 | 385 | 16 | 29 | 50 | 1.68 | 1 | 1 | |
| (20) | " | 1.0 | 720 | 713 | 623 | 16 | 29 | 50 | 1.32 | 1 | 5 | * |
| (20) | sheet bar caster | 0.8 | 1,169 | 385 | 165 | 15 | 30 | 51 | 2.04 | 1 | 1 | |

Note:
*Comparative Example

According to the present invention, the thin steel sheets having excellent ridging resistance with excellent phosphate coating property while exhibiting the high elongation and r-value can be obtained by rolling at a high strain rate. Thus, the conventional cold rolling step can not only be omitted, but also the sheet bar caster process and the strip caster process can be applied to the materials to be rolled. Therefore, the producing steps of the formable thin steel sheets can be simplified.

Steel No. 21–24:

Steel sheets having chemical compositions shown in Table 15 were produced by the converter-continuous casting process or the sheet bar caster process. In the converter-continuous casting process, a sheet bar of 20 to 30 mm in thickness was obtained through rough rolling after heating and soaking at 1,100° to 950° C.

TABLE 15

| Steel | C | Si | Mn | P | S | N | Al | (wt %) others |
|---|---|---|---|---|---|---|---|---|
| (21) | 0.040 | 0.01 | 0.30 | 0.013 | 0.009 | 0.0026 | 0.060 | — |
| (22) | 0.001 | 0.01 | 0.09 | 0.086 | 0.002 | 0.0025 | 0.026 | — |
| (23) | 0.003 | 0.02 | 0.13 | 0.009 | 0.004 | 0.0018 | 0.046 | Ti 0.025 Nb 0.008 |
| (24) | 0.003 | 0.03 | 0.81 | 0.100 | 0.006 | 0.0026 | 0.035 | Nb 0.020 |

These sheet bars were each converted into a thin steel sheet of 0.9 to 0.7 mm in thickness by using six rows of continuous finish rolling mills. Rolling at a high strain rate was carried out by using the final row of the rolling mill. The rolling conditions and the material characteristics after the continuous annealing (soaking temperature: 750° to 810° C.) are shown in Table 16. Steel No. 21 was subjected to overaging treatment at 400° C. for 2 minutes as the continuous annealing conditions after the soaking.

TABLE 16

| Steel | Sheet bar producing process | Thickness (mm) | Hot rolling conditions: Number of stand | Strain rate ($s^{-1}$) | $\dot{\varepsilon}/R$ | Finish temperature (°C.) | Material characteristics: Y.S. ($kg/mm^2$) | T.S. ($kg/mm^2$) | El (%) | TS × El | $\bar{r}$ | Ridging index | Remarks |
|---|---|---|---|---|---|---|---|---|---|---|---|---|---|
| (21) | rough rolling | 0.8 | 6 | 265 | 1.82 | 705 | 23 | 31 | 44 | 1,364 | 0.85 | 5 | * |
| | rough rolling | " | " | 360 | 0.90 | 720 | 21 | 32 | 44 | 1,408 | 1.16 | 2 | * |
| | rough rolling | " | " | 560 | 2.52 | 730 | 19 | 32 | 48 | 1,536 | 1.25 | 1 | |
| | rough rolling | " | " | 1,710 | 4.36 | 760 | 20 | 32 | 49 | 1,568 | 1.40 | 1 | |
| (22) | sheet bar caster | 1.2 | " | 402 | 0.86 | 470 | 24 | 36 | 37 | 1,332 | 1.40 | 1 | * |
| | sheet bar caster | " | " | 530 | 2.26 | 490 | 20 | 36 | 42 | 1,512 | 1.46 | 1 | |
| | sheet bar caster | " | " | 1,120 | 3.01 | 500 | 19 | 36 | 44 | 1,584 | 1.85 | 1 | |
| (23) | rough rolling | 1.0 | " | 550 | 2.15 | 730 | 14 | 29 | 55 | 1,595 | 1.57 | 1 | |
| | rough rolling | " | " | 435 | 1.25 | 850 | 17 | 30 | 48 | 1,440 | 0.89 | 5 | * |
| (24) | rough rolling | " | " | 905 | 2.76 | 430 | 22 | 41 | 40 | 1,640 | 1.60 | 1 | |

Note:
*Comparative Example

According to the present invention, the thin steel sheets having excellent ridging resistance while exhibiting excellent strength-elongation balance and r-value can be obtained by rolling at high strain rate. Thus, the conventional cold rolling step can not only be omitted, but also the sheet bar caster process and the strip caster process can be applied to the materials to be rolled. Therefore, the producing steps of the formable thin steel sheets can be simplified.

Steel Nos. 25–27:

Steel sheets having chemical compositions shown in Table 17 were produced by the converter-continuous casting process or the sheet bar caster process. In the converter-continuous casting process, a sheet bar of 20 to 30 mm in thickness was obtained through rough rolling after heating and soaking at 1,100° to 950° C.

TABLE 17

(wt %)

| Steel | C | Si | Mn | P | S | N | Al | others |
|---|---|---|---|---|---|---|---|---|
| (25) | 0.022 | 0.01 | 0.31 | 0.010 | 0.009 | 0.0042 | 0.045 | — |
| (26) | 0.002 | 0.01 | 0.06 | 0.008 | 0.001 | 0.0025 | 0.026 | Ti: 0.032 |
| (27) | 0.003 | 0.01 | 0.11 | 0.009 | 0.003 | 0.0022 | 0.040 | Ti: 0.016<br>Nb: 0.012 |

These sheet bars were rolled at a high strain rate at a sixth stand of six rows of continuous finish rolling mills, and coiled. The resultant product was subsequently subjected to annealing (soaking temperature: 700°–850° C.) and continuous hot metal dipping in a continuous hot metal (ZnAl, Pb) dipping line without being pickled.

The rolling conditions and the material characteristics after the skin pass rolling at 0.5 to 1.2% are shown in Table 18.

TABLE 18

| Steel | Sheet bar producing process | Thickness (mm) | Rolling conditions: Strain rate ($s^{-1}$) | Finish temperature (°C.) | Coiling temperature (°C.) | Kind of plating | Material characteristics: Y.S. ($kg/mm^2$) | T.S. ($Kg/mm^2$) | El (%) | $\bar{r}$ | Ridging index | Plating adhesion: Limit value in bending test | Erichsen value (mm) | Remarks |
|---|---|---|---|---|---|---|---|---|---|---|---|---|---|---|
| (25) | rough rolling | 0.8 | 225 | 655 | 260 | Zn | 24 | 33 | 41 | 0.70 | 5 | 2t | 6.5 | |
| (25) | rough rolling | " | 535 | 860 | 350 | " | 25 | 34 | 39 | 0.76 | 5 | 2t | 7.5 | * |
| (25) | rough rolling | " | 406 | 685 | 505 | " | 23 | 32 | 43 | 1.18 | 1 | 4t | 3.8 | * |
| (25) | rough rolling | " | 545 | 645 | 290 | " | 20 | 32 | 44 | 1.22 | 1 | 0t | 10.2 | |
| (25) | rough rolling | " | 1,215 | 725 | 355 | Al | 19 | 32 | 47 | 1.36 | 1 | 0t | 10.5 | |
| (25) | rough rolling | " | 1,096 | 560 | 245 | Pb | 20 | 31 | 49 | 1.40 | 1 | 0t | 10.1 | |
| (26) | sheet bar caster | 1.2 | 385 | 745 | 655 | Al | 17 | 30 | 45 | 1.20 | 1 | 4t | 5.2 | * |
| (26) | sheet bar caster | " | 763 | 545 | 295 | Al | 16 | 30 | 48 | 1.51 | 1 | 0t | 11.1 | |
| (27) | rough rolling | 0.8 | 522 | 655 | 475 | Zn | 18 | 30 | 45 | 1.35 | 1 | 3t | 7.6 | * |
| (27) | rough | " | 709 | 435 | 105 | Zn | 15 | 29 | 51 | 1.45 | 1 | 0t | 9.8 | |

TABLE 18-continued

| Steel | Sheet bar producing process | Thickness (mm) | Rolling conditions: Strain rate ($s^{-1}$) | Finish temperature (°C.) | Coiling temperature (°C.) | Kind of plating | Material characteristics: Y.S. (kg/mm²) | T.S. (Kg/mm²) | El (%) | $\bar{r}$ | Ridging index | Plating adhesion: Limit value in bending test | Erichsen value (mm) | Remarks |
|---|---|---|---|---|---|---|---|---|---|---|---|---|---|---|
| (27) | rolling rough rolling | " | 1,615 | 535 | 180 | Zn | 14 | 31 | 50 | 1.82 | 1 | 0t | 11.5 | |
| (27) | rolling rough rolling | " | 968 | 600 | 255 | Pb | 16 | 30 | 50 | 1.61 | 1 | 0t | 10.6 | |

Note:
*Comparative Example

In Steel Nos. 25–27, the ridging resistance was judged after the plated layer was chemically removed.

The plating adhesion was evaluated in the manner mentioned above. All of Steels having no * mark are excellent in formability, ridging resistance and plate adhesion.

According to the present invention, the thin steel sheets having excellent ridging resistance and excellent plate adhesion while exhibiting the high elongation and r-value can be obtained by rolling at high strain rate. Thus, the conventional cold rolling step can not only be omitted, but also the sheet bar caster process and the strip caster process can be applied to the materials to be rolled. Therefore, the producing steps of the formable thin hot metal-plated steel sheets can be simplified.

Steel Nos. 28–33:

Steel sheets having chemical compositions shown in Table 19 were produced as sheet bars of 30 mm in thickness by the converter-continuous casting process or the sheet bar caster process. In the converter-continuous casting process, the sheet bar was obtained through rough rolling after heating and soaking at 1,100° to 950° C.

TABLE 19

| Steel | C | Si | Mn | P | S | N | Al | (wt %) others |
|---|---|---|---|---|---|---|---|---|
| (28) | 0.03 | 0.02 | 0.26 | 0.011 | 0.009 | 0.0035 | 0.045 | — |
| (29) | 0.02 | 0.02 | 0.22 | 0.014 | 0.008 | 0.0039 | 0.040 | B: 0.002 |
| (30) | 0.002 | 0.01 | 0.18 | 0.008 | 0.007 | 0.0022 | 0.022 | — |
| (31) | 0.003 | 0.02 | 0.15 | 0.009 | 0.005 | 0.0021 | 0.029 | Ti: 0.029 |
| (32) | 0.001 | 0.01 | 0.12 | 0.008 | 0.004 | 0.0025 | 0.024 | Nb: 0.014 |
| (33) | 0.002 | 0.02 | 0.19 | 0.007 | 0.006 | 0.0022 | 0.026 | Ti: 0.015 |

TABLE 19-continued

| Steel | C | Si | Mn | P | S | N | Al | (wt %) others |
|---|---|---|---|---|---|---|---|---|
| | | | | | | | | Nb: 0.008 |

These sheet bars were each converted into a thin steel sheet of 0.8 to 1.6 mm in thickness by using six rows of continuous finish rolling mills. Rolling at a high strain rate was carried out by using the final row of the rolling mill. The rolling conditions and the material characteristics after the continuous annealing (soaking temperature: 750° to 810° C.) are shown in Table 20.

TABLE 20

| Steel | Sheet bar producing process | Thickness (mm) | Rolling conditions: Strain rate ($s^{-1}$) | Rolling temperature (°C.) | Material characteristics: Y.S. (kg/mm²) | T.S. (kg/mm²) | El (%) | $\bar{r}$ | Ridging index | Young's modulus (kg/mm²) | Remarks |
|---|---|---|---|---|---|---|---|---|---|---|---|
| (28) | rough rolling | 1.6 | 870 | 712 | 20 | 33 | 45 | 1.28 | 1 | 21,500 | * |
| (28) | " | " | 1,150 | 548 | 21 | 34 | 45 | 1.44 | 1 | 23,700 | |
| (29) | " | 1.4 | 1,140 | 491 | 20 | 34 | 45 | 1.42 | 1 | 23,000 | |
| (29) | sheet bar caster | " | 542 | 629 | 20 | 33 | 44 | 1.30 | 1 | 21,400 | * |
| (30) | " | " | 1,032 | 517 | 16 | 28 | 54 | 1.86 | 1 | 22,800 | |
| (30) | " | " | 506 | 733 | 15 | 28 | 50 | 1.54 | 1 | 21,200 | * |
| (30) | rough rolling | 1.0 | 682 | 898 | 17 | 29 | 47 | 1.02 | 5 | 20,800 | * |
| (31) | " | " | 763 | 436 | 16 | 28 | 50 | 1.92 | 1 | 22,500 | |
| (31) | " | " | 236 | 650 | 17 | 30 | 46 | 1.01 | 5 | 20,900 | * |
| (31) | " | " | 874 | 535 | 16 | 29 | 52 | 1.76 | 1 | 22,900 | |
| (32) | " | " | 1,952 | 706 | 16 | 29 | 53 | 1.61 | 1 | 23,400 | |
| (32) | " | 0.8 | 372 | 386 | 15 | 28 | 50 | 1.98 | 2 | 22,200 | |
| (32) | sheet bar caster | " | 624 | 567 | 16 | 28 | 50 | 1.70 | 1 | 21,800 | * |
| (33) | " | " | 1,632 | 533 | 15 | 30 | 51 | 1.81 | 1 | 21,600 | * |
| (33) | " | 1.2 | 724 | 421 | 16 | 29 | 50 | 1.90 | 1 | 22,300 | |
| (33) | rough rolling | " | 1,474 | 603 | 16 | 29 | 52 | 1.65 | 1 | 23,600 | |

Note:
*Comparative Example

According to the present invention, the thin steel sheets having excellent ridging resistance and excellent bulging rigidity while exhibiting the high elongation and r-value can be obtained by rolling at a high strain rate. Thus, the conventional cold rolling step can not only be omited, but also the sheet bar caster process and the strip caster process can be applied to the materials to be rolled. Therefore, the producing steps of the formable thin steel sheets can be simplified.

What is claimed is:

1. A process for producing a formable thin steel sheet excellent in ridging resistance, which comprises finish rolling a low carbon steel at a strain rate ($\dot{\varepsilon}$) of not less than 300 ($s^{-1}$) in a temperature range of 800° to 300° C. in at least one pass when the low carbon steel is rolled into a specified thickness, and subsequently subjecting said sheet to recrystallization annealing.

2. A process for producing a formable thin steel sheet excellent in ridging resistance according to claim 1, wherein said finish rolling is performed under the conditions of $\dot{\epsilon} \geqq 0.8T+60$ in which T is a rolling temperature (°C.).

3. A process for producing a formable thin steel sheet excellent in ridging resistance according to claim 1, wherein the finish rolling is carried out under the condition that the coefficient of friction ($\mu$) and the strain rate ($\dot{\epsilon}$) satisfy $\dot{\epsilon}/\mu \geqq 1{,}000$.

4. A process for producing a formable thin steel sheet excellent in ridging resistance according to claim 1, wherein the finish rolling is carried out under application of tension.

5. A process for producing a formable thin steel sheet excellent in ridging resistance according to claim 1, further comprising coiling the sheet at not more than 400° C. between the rolling and recrystallization annealing steps.

6. A process for producing a formable steel sheet excellent in ridging resistance according to claim 1, wherein the finish rolling is carried out under the relation of $\epsilon/R \geqq 2.0$ in which R is a radius (mm) of work rolls.

7. A process for producing a formable steel sheet excellent in ridging resistance according to claim 1, further comprising coiling the sheet at a temperature of not more than 400° C., and the recrystallization and a plating are subsequently carried out in a continuous hot metal dipping line of an in-line annealing system.

8. A process for producing a formable thin steel sheet excellent in ridging resistance according to claim 1, wherein the finish rolling is carried out under the conditions that a limit strain rate ($\dot{\epsilon}_c$) complying with the following equation (1) satisfies the following relation (2)

$$\ln \dot{\epsilon}_c = -3{,}650/(273+T)+11.5 \quad (1)$$

in which T is a rolling temperature (°C.)

$$0.5\dot{\epsilon}_c \leqq \dot{\epsilon} \leqq 1.5\dot{\epsilon}_c \quad (2).$$

* * * * *